US005367297A

United States Patent [19]

Yokoyama

[11] Patent Number: 5,367,297

[45] Date of Patent: Nov. 22, 1994

[54] DISPLAY SYSTEM FOR VESSEL

[75] Inventor: Kazuhiko Yokoyama, Hamamatsu, Japan

[73] Assignee: Sanshin Kogyo Kabushiki Kaisha, Hamamatsu, Japan

[21] Appl. No.: 41,284

[22] Filed: Mar. 30, 1993

Related U.S. Application Data

[63] Continuation of Ser. No. 706,578, May 28, 1991, abandoned.

[30] Foreign Application Priority Data

May 29, 1990 [JP] Japan ..... 2-137052

[51] Int. Cl.[5] ..... G08B 23/00

[52] U.S. Cl. ..... 340/984; 367/107

[58] Field of Search ..... 340/984, 980, 995, 987, 340/461, 438, 459, 973, 713, 714; 367/110, 111, 107; 364/424.01, 424.03; 440/2; 114/214, 215; 123/198 D

[56] References Cited

U.S. PATENT DOCUMENTS

| | | | |
|---|---|---|---|
| 3,399,402 | 8/1968 | Brown, Jr. | 340/713 |
| 3,590,315 | 6/1971 | Hoff et al. | 345/215 |
| 4,555,694 | 11/1985 | Yanagishima et al. | 340/461 |
| 4,646,059 | 2/1987 | Iwamoto et al. | 340/461 |
| 4,868,563 | 9/1989 | Stair et al. | 345/50 |
| 4,988,996 | 1/1991 | Ito | 367/111 |
| 5,020,492 | 6/1991 | Kanno | 340/438 |
| 5,043,727 | 8/1991 | Ito | 340/461 |
| 5,063,381 | 11/1991 | Ito | 340/461 |
| 5,216,421 | 6/1993 | Sawada et al. | 340/984 |

FOREIGN PATENT DOCUMENTS 2-42314 2/1990 Japan .

*Primary Examiner*—Brent Swarthout

*Attorney, Agent, or Firm*—Knobbe, Martens, Olson & Bear

[57] ABSTRACT

A display system in a vessel which includes various sensors for detecting various operating and navigating conditions of the vessel and a single display unit for displaying information regarding these conditions. The single display unit is comprised of a fixed display which displays information regarding particular operating and navigating conditions that are frequently monitored. The single display unit also includes a variable display which has a standby state and a display state and which also has a plurality of alternate display modes and a warning display which automatically displays warning information regarding at least one of the conditions that is being sensed when the particular condition is detected to be outside of its predetermined range. A control unit maintains the variable display in its standby state wherein only a minimum amount of electric power is required when no output signal is received from any of the sensors which sense information that appears on the warning display indicating that the particular sensed condition is abnormal and when none of the alternate display modes has been selected. When warning information is sensed or when one of the alternate display modes is selected, the control unit applies rated electric power to the variable display to establish its display state.

11 Claims, 4 Drawing Sheets

DISPLAY SYSTEM FOR VESSEL

This is a continuation of U.S. patent application Ser. No. 07/706,578, filed May 28, 1991, now abandoned.

BACKGROUND OF THE INVENTION

The invention relates to a display system for a marine vessel or other vehicle, and more particularly to a display system having a single display unit for displaying information regarding various operating and navigating conditions of the vessel or vehicle and, when used in a marine vessel, for displaying fish detection information as well. The single display unit includes a variable display which has both a standby state and a display state and means for controlling the state of the variable display.

One form of display system for marine vessels uses a single display unit having fixed and variable displays for displaying certain operating and navigating information. The variable display may also include a fish detection display and a warning display of information regarding selected operating and navigating conditions. When one or more of these selected conditions is detected to be abnormal, one or more corresponding warnings automatically appears on the warning display of the variable display. Such a display system not only improves the visibility of displayed information but also enables the operator to easily and promptly recognize and cope with any abnormality being monitored.

Although this system has certain advantages, its variable display has previously been constructed so that once it is turned on, it continually displays operation and navigational information, fish detection information or warning information. As a result, much electrical power is required to maintain the variable display in a continued state of display. In addition, once the variable display is actuated, all of the sensors associated with the variable display are kept in an energized state, whether needed or not, so as to require continuous electric power. For example, the fish detector is maintained in the energized state once the variable display is actuated, even though fish detection information is usually not required at the start of operation.

It is, therefore, a principal object of this invention to provide an arrangement capable of displaying a wide variety of operational and navigational information on a single display unit in a quick and timely manner using a minimum of electric power.

It is another object of this invention to provide a single display unit which is capable of displaying a wide variety of operational and navigational information, and which includes a variable display having a standby state and a display state and means for controlling the state of the variable display so as to minimize the amount of electric power required.

It is a further object of this invention to provide a display system for a marine vessel which improves the operability of the vessel.

SUMMARY OF THE INVENTION

The invention is adapted to be embodied in a display system in a vessel which includes various sensors including at least one warning information sensor for sensing various operating and navigating conditions of the vessel and a single display unit comprised of a variable display having a standby state and a display state and which has at least one alternate display mode for displaying information received from at least one sensor regarding at least one of the sensed operating and navigating conditions. The variable display also hah a warning display which automatically displays warning information received from at least one warning information sensor regarding at least one of the various operating and navigating conditions when that particular condition is detected to be outside of a predetermined range for that particular condition regardless of whether an alternate display mode is being displayed. Means are provided for selecting the alternate display mode or between them when warning information is not being displayed on the warning display. In accordance with the invention, the display system further comprises means for controlling the state of the variable display based on output signals received from at least one warning information sensor indicating that at least one of the conditions is outside of the predetermined range for that particular condition and based on whether an alternate display mode has been selected.

DETAILED DESCRIPTION OF THE PREFERRED EMBODIMENT OF THE INVENTION

Figure 1:
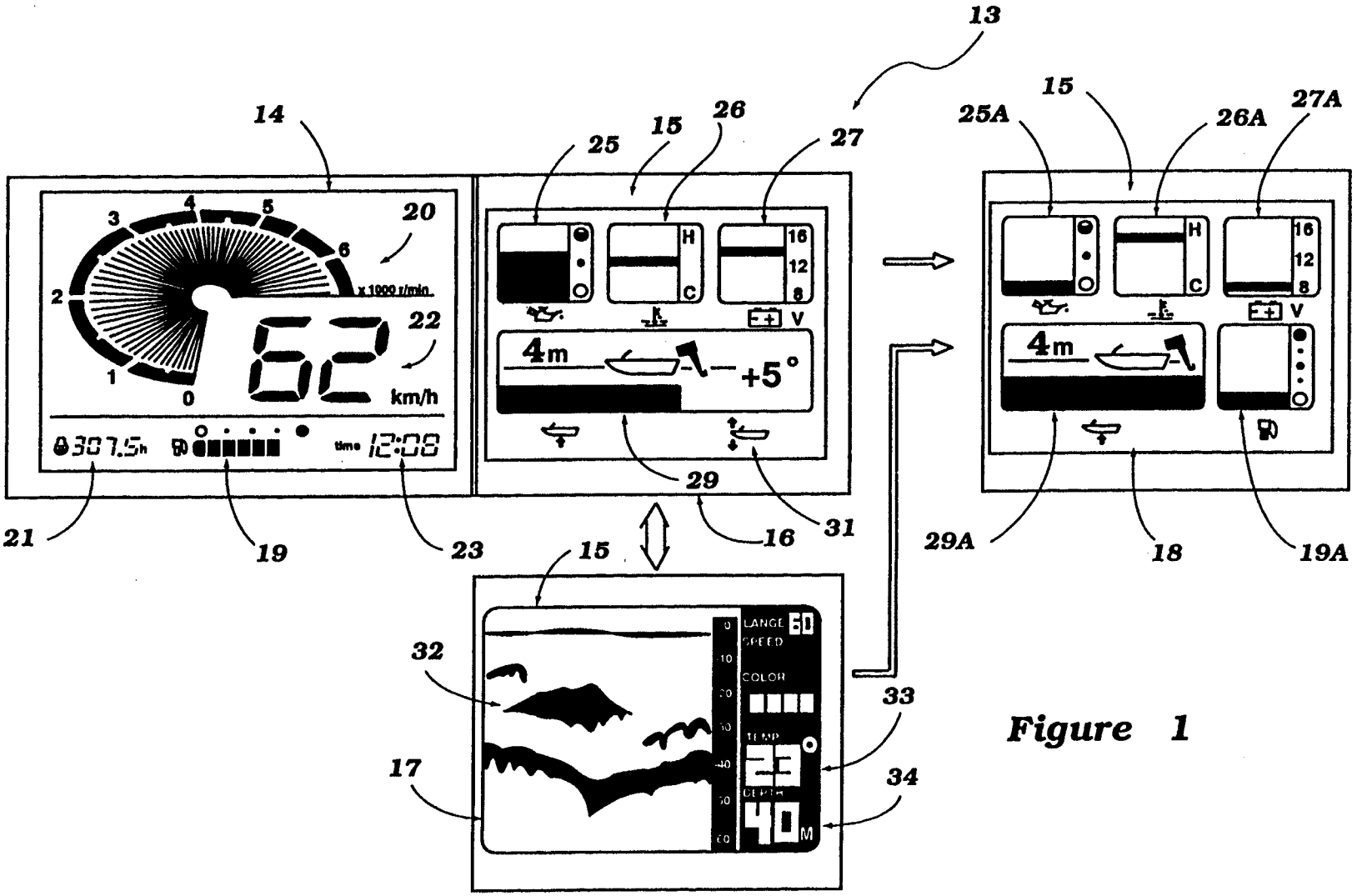
FIG. 1 is a schematic illustration showing an embodiment of the display unit, including the fixed and variable displays, according to the present invention.
Figure 2:
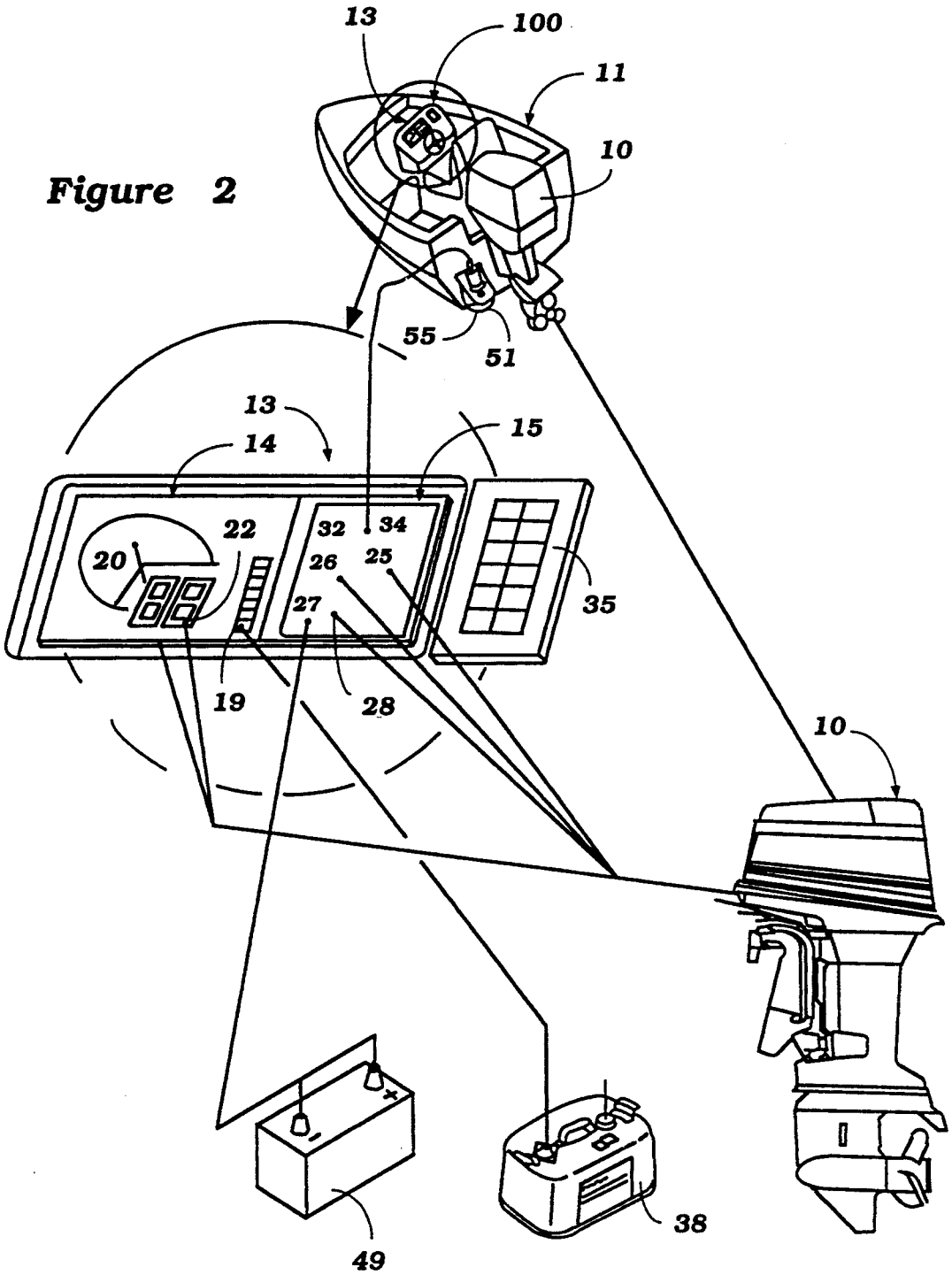
FIG. 2 is a schematic illustration of an arrangement and construction of the display system in combination with a marine vessel.

Referring first to FIGS. 1 and 2, a single display unit 13 of a display system 12 is depicted and is adapted for use in a vessel and preferably in a marine vessel 11 having an outboard drive unit 10. Although the invention is described in connection with a marine vessel which has an outboard drive unit, it is to be understood that the invention may also be practiced with other types of marine vessels as well as with land vehicles. Thus, the term "vessel" as used in the claims is intended to refer to both a vessel and a vehicle. It should be noted, however, that the invention has particular utility in connection with a marine vessel having an outboard drive unit.

In the illustrated embodiment, the outboard drive unit 10 includes an engine, a driveshaft housing and propelling means for propelling the vessel 11 through the water.

The display unit 13 comprises a fixed display 14, preferably of the liquid crystal display (LCD) type, and a variable display 15, preferably of the cathode ray tube (CRT) type. The variable display 15 has a plurality of different alternate display modes, including a first display of information indicated generally by the reference numeral 16 and a second display of fish detection information 17. Additional alternate display modes embodied in the variable display 15 include a long range navigational (loran) information display mode and a radar information display mode. The variable display 15 also has a warning display of warning information indicated by the numeral 18.

In the preferred embodiment, once the display system 12 is actuated, the fixed display 14 constantly displays information typically watched frequently by the vessel operator during the operation of the vessel 11. This information includes fuel level 19, engine speed 20, cumulative engine operating time 21, vessel speed 22 and time which is displayed on a clock 23.

In accordance with the invention, the variable display 15, on the other hand, has a standby state in which no information is displayed, and a display state in which either warning information or one of the plurality of alternate display modes is displayed at a time as hereinafter described. The alternate display modes of information 16 and 17 as well as the loran and radar display modes will normally contain information of the type not as frequently watched as the information monitored on the fixed display 14.

The first of these alternate display modes 16 displays operational and navigational information including information regarding the inclination of the vessel hull and the trim position of the outboard motor 10. In the preferred embodiment, this includes information regarding oil level 25, engine coolant temperature 26, battery voltage 27, trim angle of the drive unit 28, water depth 29 and hull inclination 31. The second or these alternate display modes 17 includes information regarding the detection of fish 32 including the presence or absence of fish and may also include relative location of the fish, and water temperature 33 and water depth 34 with respect to the fish location. As previously noted, the variable display 15 also includes a loran display mode and a radar information display mode.

The warning display 18 shows warning information for selected operating and navigating conditions that may also be displayed on either the fixed display 14 or the first display mode 16 of the variable display 15. This includes a fuel level warning 19A, an oil level warning 25A, an engine coolant temperature warning 26A, a battery voltage warning 27A and a water depth warning 29A. One or more of these warnings is automatically displayed on the warning display 18 of the variable display 15 when the condition relating to that warning is detected to be outside of a predetermined range for that particular condition. That is, the warning display 18 will override any of the alternate display modes (16, 17, loran or radar) and appear on the variable display 15 when warning information is sensed. The warning display 18 will appear even if none of the alternate display modes are being displayed when warning information is sensed. The warning or warnings are flashingly displayed and may be accompanied by a warning buzzer sound.

FIG. 2 shows a schematic arrangement of the display system 12 embodied in a marine vessel 11. As shown in FIG. 2, the display system 12 further includes a mode switch 35 for actuating the display state of the variable display 15 and selecting one of the alternate display modes 16, 17, loran information or radar information when no warning information is being displayed. Once the display system 12 is actuated, if no warning information is sensed, the operator can turn on the first display mode 16 by depressing the mode switch 35. If the switch 35 is actuated again the variable display 15 will change to the fish detection display mode 17. By depressing the switch 35 again, the loran display mode will appear on the variable display 15, and by pressing the switch 35 another time, the radar display mode will come into view on the variable display 15. Depressing the switch 35 again will return the variable display to its standby state. The sequence can then be repeated. It should be noted that this sequence is exemplary only and that other sequences may be used; however, the ability of the operator to select one of the alternate display modes is, as previously noted, subject to there being no warning information sensed. In the preferred embodiment, the display unit 13 and mode switch 35 are positioned adjacent to one another on the dashboard of the marine vessel 11.

In the illustrated embodiment, a main display, indicated generally by the reference numeral 100 is positioned in front of the driver's seat on the dashboard. This main display configuration 100 includes the display unit 13, the mode switch 35 and a control unit (see FIG. 3).

Figure 3:
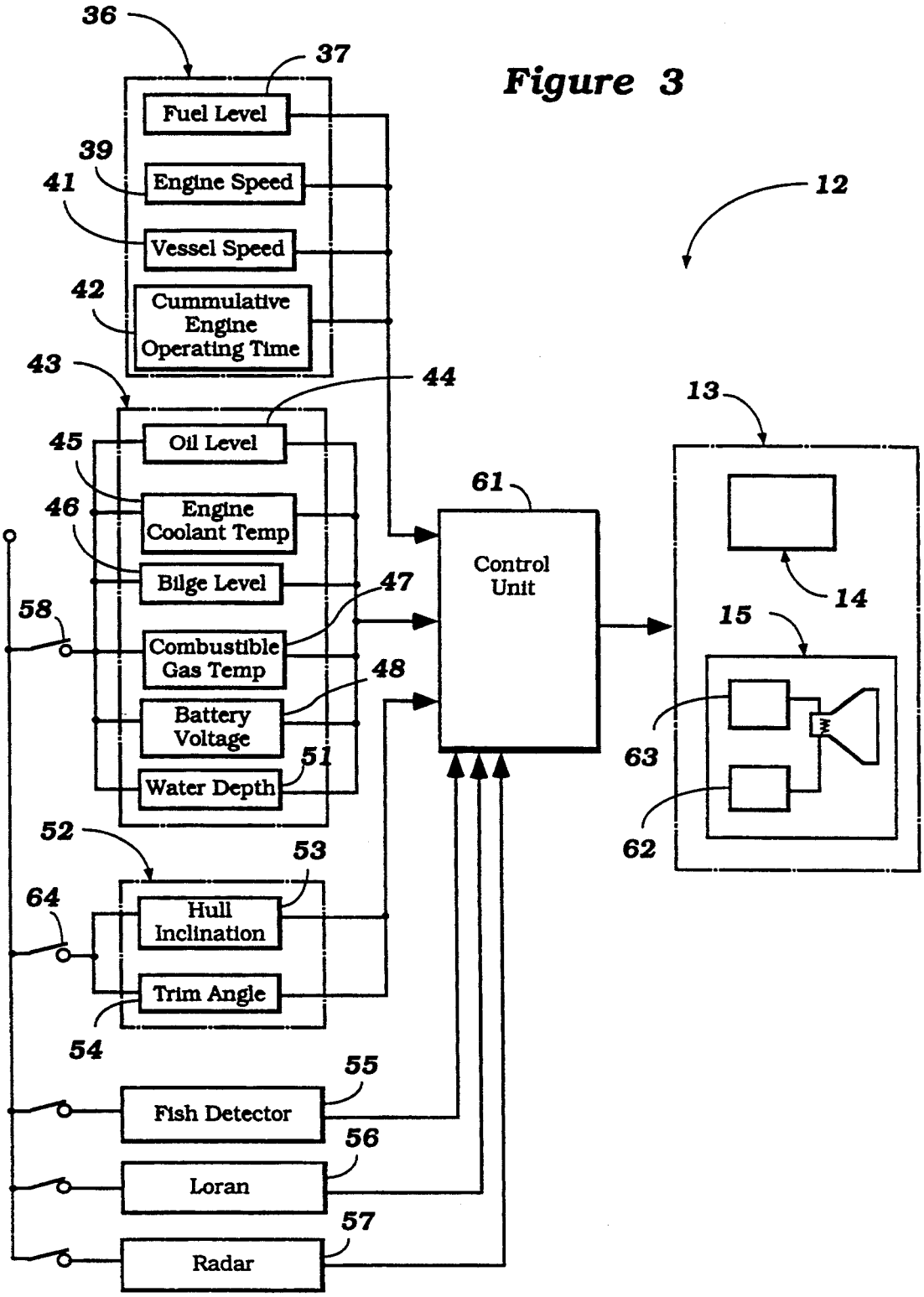
FIG. 3 is a block diagram showing an arrangement of the display system.

Referring now to FIG. 3, the display system 12 further includes a plurality of sensors for sensing the various operating and navigating conditions of the marine vessel 11 including hull inclination and outboard motor trim position, as well as for sensing fish. For example, the system 12 employs a first group of sensors 36 which includes a fuel level sensor 37 that senses the level of fuel in a fuel tank 38 (see FIG. 2), an engine speed sensor 39, a vessel speed sensor 41 and a cumulative engine operating time sensor 42. The sensors of this first group 36 correspond with the information on the fixed display 14.

There is also a warning information sensor group 43 which in the illustrated embodiment constitutes an oil level sensor 44, an engine coolant temperature sensor 45, a bilge level sensor 46, a combustible gas temperature sensor 47, a battery voltage sensor 48 on the battery 49 (see FIG. 2) and a water depth sensor 51. Also included in this warning information sensor group 43 is the fuel level sensor 37. Information sensed by the sensors in this group 43 appears on the warning display mode 18.

A third group of sensors 52 corresponds to the information displayed on the display mode 16 and includes the oil level sensor 44, the engine coolant temperature sensor 45, the battery voltage sensor 48 and the water depth sensor 51. Also included in this third sensor group 52 is a hull inclination sensor 53 and a trim angle sensor 54 for the outboard drive unit 10.

In addition, there is a fish detector 55, a loran 56 and a radar 57 which sense information that appears on the fish detection display mode 17, the loran display mode and the radar display mode respectively.

When the main switch of the vessel 11 is turned on, a warning sensor switch 58 is automatically turned on to actuate the warning information sensor group 43. A power switch (not shown) of a control unit 61 is also automatically turned on to actuate the control unit 61. A heater circuit 62 for warming up the variable display 15 is then actuated by the control unit 61 which also applies idling or a minimum of electric power to a driving circuit 63 to establish the standby state of the variable display 15. When this occurs, the control unit 61 is able to process the output signals received from the sensors in the warning information sensor group 43. In the standby state, the control unit 61 is also able to respond to the display mode select switch 35 which is in circuit with the control unit 61.

The control unit 61 includes an analog/digital converter and, in addition, stores a predetermined range for each of the conditions which is monitored on the warning display 18. Thus, when the control unit 61 determines that one or more of the warning conditions is detected to be outside of its predetermined range, the control unit 61 automatically applies rated electric power to the variable display 15 to establish its display state so that warning information regarding the particular condition(s) may be displayed on the warning display 18. The warning display mode 18 may then be cancelled by the operator if desired by actuating a canceling switch (not illustrated) of the control unit 61.

Rated electric power can also be applied to the variable display 15 to establish its display state using the mode switch 35. When the mode switch 35 is first depressed, a sensor group switch 64 is actuated to turn on the sensors in group 52, fish detector 55, loran 56 and radar 57. In addition, when the mode switch 35 is first depressed, the control unit 61 applies rated electric power to the variable display 15 to establish its display state so as to display one of the alternate display modes, display mode 16 in the illustrated embodiment, on the variable display 15. The other display modes 17, loran or radar may be displayed on the variable display 15, in turn, by depressing the mode switch 35 one or more times until the desired display mode appears.

Figure 4:
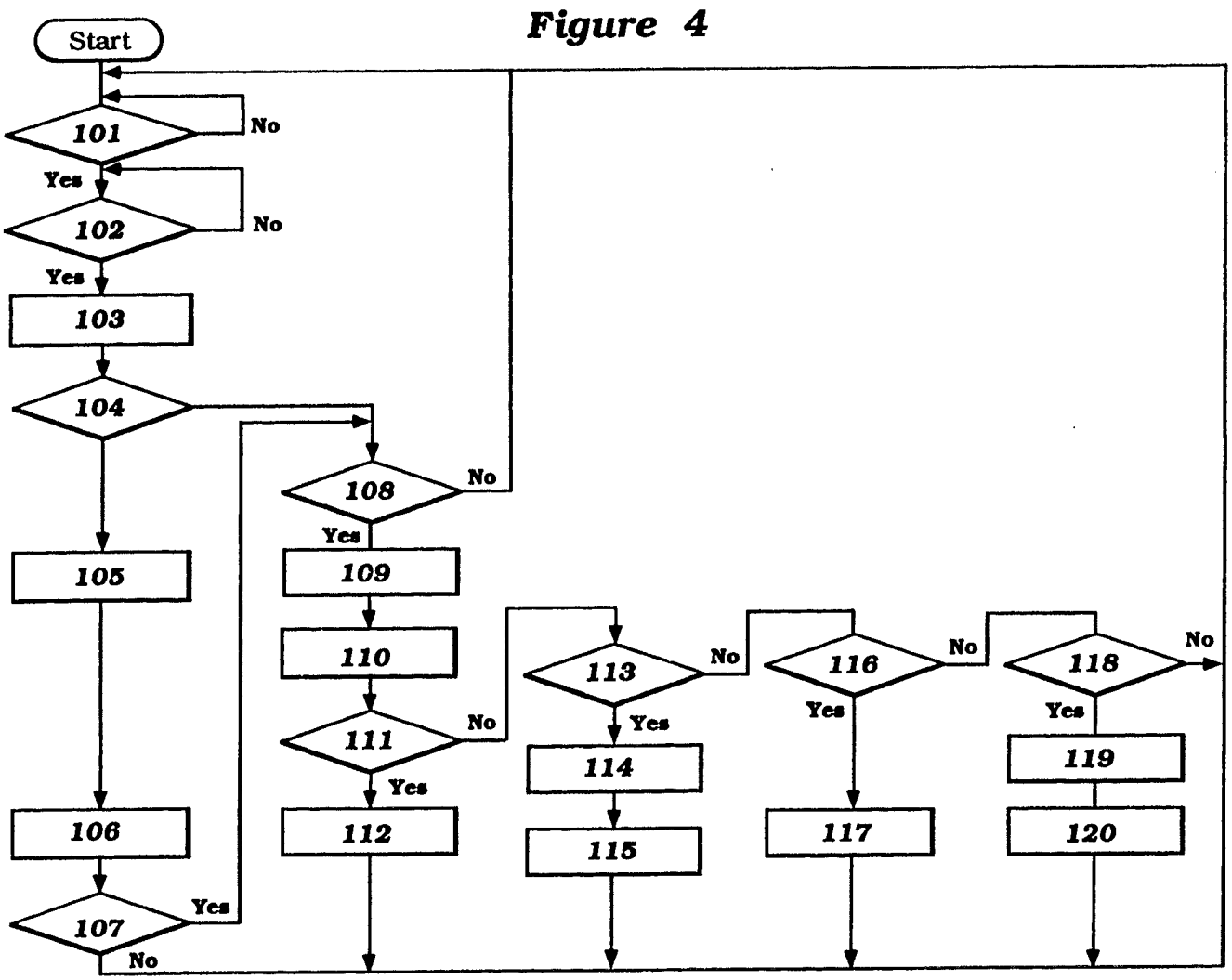
FIG. 4 is a flow chart showing an embodiment of the operation of the display system.

FIG. 4 is a flow chart showing an embodiment of the operation of the display system 12, and in particular the operation of the .variable display 15. At the start of the program, it is first determined whether or not the sensors of the warning information sensor group 43 are on (step 101). If not, they are turned on using the main switch of the vessel 11 as previously described. Next, a determination is made as to whether or not the control unit power is on (step 102). If not, it is turned on. Once the warning information sensor group 43 and control unit 61 are actuated, idling electric power is applied to the variable display 15 to establish its standby state (step 103). At this point, if any of the sensors in the warning information sensor group 43 transmit output signals to the control unit 61 indicating that a particular condition is sensed to be outside of its predetermined range (step 104), then the control unit 61 applies rated electric power to the variable display 15 to establish its display state (step 105). In that case, the warning display 18 automatically appears on the variable display 15 (step 106). The warning display 18 may then be canceled by actuating the canceling switch in step 107. It the canceling switch is not on, the program repeats. If, however, the canceling switch is actuated, or if at step 104 no warning information is sensed, the mode switch 35 may be used to actuate sensor group 52, the fish detector 55, loran 56 and radar 57.

The switch 35 may also be used to selectively actuate the display mode 16 which corresponds to the sensor group 52, the fish display mode, the loran display mode or the radar display mode (step 108). If the mode switch 35 is first actuated at this point the sensors in group 52, fish detector 55, loran 56 and radar 57 are turned on (step 109). When that occurs, rated electric power is also applied to the variable display 15 (step 110) and if the operator wishes to view the display mode 16 (step 111), he may do so as it will now appear on the variable display 15 (step 112). At that point, the program repeats.

Referring back to step 111, if the operator wishes to view the fish detection display mode 17 instead of display mode 16 (step 113), he uses the switch 35 to select that mode 17 and to actuate a supersonic wave transmitter-receiver circuit of the control unit 61 (step 114). This circuit may be of any known construction. The fish detection display mode 17 can then be seen on the variable display 15 (step 115). At that point, the program repeats.

Returning to step 113, rather than selecting the display 16 or fish detection display mode 17, the operator may instead select the loran display mode using the mode switch 35 (step 116). In this case, the loran display mode will appear on the variable display 15 (step 117). The program then repeats.

Referring back to the step 116 juncture, the radar display mode may be selected instead of the other display modes using switch 35 (step 118). When the switch 35 is depressed at this time, a radar transmitter-receiver circuit of the control unit 61 is actuated (step 119) and the radar display mode comes into view on the variable display 15 (step 120). This circuit may be of any known construction.

Following step 120, the program repeats which also occurs if the radar display mode is not selected at step 118. After going through the display modes using the mode switch 35, it may then be used to return the variable display 15 to its standby state subject to there being no warning information sensed.

With this arrangement, the variable display 15 is maintained in its standby state, requiring only a minimum amount of electric power when no warning information is being sensed and when no other display mode has been selected, but may be changed to its display state quickly by having its rated electric power applied in order to display information when required.

It should be readily apparent from the foregoing description that a display system which provides a wide variety of information for improving the operability of an associated vessel while minimizing the amount of electric power required for operation has been illustrated and described. Although this is the case, it is to be understood that various changes and modifications may be made without departing from the spirit and scope of the invention, as defined by the appended claims. For example, the displayed information and sensors may be grouped differently. In addition, the alternate display modes may be arranged to appear in a different order when the mode switch 35 is depressed.

I claim:

1. A display system for a vessel comprising a plurality of sensors including at least one warning information sensor for sensing a plurality of operating and navigating conditions of the vessel and a single display unit comprised of a variable display screen having a standby state during which no information is displayed and a display state comprised of a first display mode for displaying information from certain of said sensors including sensors of operating conditions and at least one alternate display mode for displaying information received from other of said sensors including sensors of navigating conditions and a warning display mode which automatically displays warning information received from at least one warning information sensor regarding at least one of the plurality of operating and navigating conditions when that particular condition is detected to be outside of a predetermined range for that particular condition regardless of which display mode is being displayed, means for selecting one of said display modes when warning information is not being displayed on said warning display, and means for controlling the state of said variable display based on output signals received from at least one warning information sensor indicating that at least one of the conditions is outside of the predetermined range for the particular condition and based on whether said alternate display mode has been selected, said display system further comprising a circuit for either illuminating said variable display when a warning signal is present and/or when a display mode is selected or applying a minimum amount of power to said variable display to establish its standby state at other times.

2. A display system as recited in claim 1, wherein when said controlling means receives output signals from at least one warning information sensor indicating that at least one of the conditions is outside of a predetermined range for that particular condition, said controlling means increases the amount of power applied by said circuit to said variable display to establish its display state.

3. A display system as recited in claim 1, wherein when said alternate display mode is selected, said controlling means increases the amount of power applied by said circuit to said variable display to establish its display state.

4. A display system as recited in claim 1, wherein said variable display has a plurality of alternate display modes each for displaying information received from at least one sensor regarding at least one of the sensed plurality of operating and navigating conditions, wherein said warning display automatically displays warning information received from at least one warning information sensor regarding at least one of the plurality of operating and navigating conditions when that particular condition is detected to be outside of a predetermined range for that particular condition regardless of which alternate display mode is being displayed, wherein said selecting means selects between the alternate display modes when warning information is not being displayed on said warning display, and wherein said controlling means controls the state of said variable display based on said output signals and based on whether one of said alternate display modes has been selected.

5. A display system as recited in claim 4, wherein when said controlling means does not receive any output signals from at least one warning information sensor indicating that at least one of the conditions is outside of a predetermined range for that particular condition and when none of said alternate display modes is selected, said controlling means applies a minimum amount of power by said circuit to said variable display to establish its standby state.

6. A display system as recited in claim 5, wherein when said controlling means receives output signals from at least one warning information sensor indicating that at least one of the conditions is outside of a predetermined range for that particular condition, said controlling means increases the amount of power applied by said circuit to said variable display to establish its display state.

7. A display system as recited in claim 5, wherein when one of said alternate display modes is selected, said controlling means increases the amount of power applied by said circuit to said variable display to establish its display state.

8. A display system as recited in claim 4, wherein one of said plurality of alternate display modes displays operational and navigational information including information regarding the inclination of the hull of the vessel.

9. A display system as recited in claim 4, further comprising means for detecting fish and wherein one of said plurality of alternate display modes is a fish detection display mode.

10. A display system as recited in claim 4, wherein said single display unit further comprises a fixed display for displaying information received from at least one sensor regarding at least one of the sensed plurality of operating and navigating conditions.

11. A display system as recited in claim 1, wherein the first display mode displays information including information regarding the inclination of the hull of the vessel from a vessel sensor and the alternate display mode displays radar information from a radar sensor.

* * * * *